US006425500B2

(12) United States Patent
McNally

(10) Patent No.: US 6,425,500 B2
(45) Date of Patent: Jul. 30, 2002

(54) HAND HELD SALT DISPENSING DEVICE

(76) Inventor: Brian G. McNally, 21222 Meridian Rd., Grosse Isle, MI (US) 48138

( * ) Notice: Subject to any disclaimer, the term of this patent is extended or adjusted under 35 U.S.C. 154(b) by 0 days.

(21) Appl. No.: 09/962,763

(22) Filed: Sep. 25, 2001

Related U.S. Application Data

(63) Continuation-in-part of application No. 09/595,596, filed on Jun. 15, 2000.
(60) Provisional application No. 60/139,716, filed on Jun. 18, 1999.

(51) Int. Cl.[7] ..... G01F 11/20
(52) U.S. Cl. ..... 222/175; 222/414; 222/325; 222/368; 222/333
(58) Field of Search ..... 222/175, 410, 222/414, 363, 368, 333, 367, 329, 325; 221/277, 222; 291/32, 28

(56) References Cited

U.S. PATENT DOCUMENTS

| | | | | | |
|---|---|---|---|---|---|
| 407,650 | A | * | 7/1889 | Estabrook et al. | 222/184 |
| 425,338 | A | | 4/1890 | Muller | |
| 763,750 | A | * | 6/1904 | Grimes | 222/410 |
| 1,022,774 | A | * | 4/1912 | De Julio | 222/368 |
| 1,855,214 | A | * | 4/1932 | Alton | 222/183 |
| 1,940,138 | A | * | 12/1933 | McAdam | 222/242 |
| 2,518,520 | A | * | 8/1950 | Broun | 222/368 |
| 2,571,781 | A | * | 10/1951 | Sutch | 414/412 |
| 2,574,166 | A | * | 11/1951 | Boydstun | 222/336 |
| 2,892,286 | A | | 6/1959 | Martin | 43/148 |
| 3,096,984 | A | | 7/1963 | Garrison | 275/12 |
| 3,157,402 | A | | 11/1964 | Love, Jr. | 275/12 |
| 3,979,071 | A | | 9/1976 | Biggs, Jr. | 239/653 |
| 3,993,225 | A | | 11/1976 | Manni | 222/324 |
| 4,071,170 | A | * | 1/1978 | Gunzel et al. | 222/199 |
| 4,957,219 | A | * | 9/1990 | Robbins et al. | 222/368 |
| 5,119,993 | A | * | 6/1992 | Gunzel et al. | 239/600 |
| 5,123,598 | A | | 6/1992 | Courtney et al. | 239/686 |
| 6,089,477 | A | | 7/2000 | Dillon | 239/653 |
| 6,172,477 | B1 | * | 1/2001 | Kim | 320/114 |
| 6,293,440 | B1 | * | 9/2001 | Weaver | 222/363 |

* cited by examiner

*Primary Examiner*—William Doerrler
*Assistant Examiner*—Stephanie Willatt
(74) *Attorney, Agent, or Firm*—Gifford, Krass, Groh, Sprinkle, Anderson & Citkowski, P.C.

(57) ABSTRACT

A portable device for dispensing a particulate salt material upon a ground surface having a body with a substantially hollow interior, a forwardly located and open end and a reclosable end cap engaged with a rearwardly located end for permitting the hollow interior to be filled holding a volume of the particulate material. A rotor element is mounted in communication with the first open end and includes a plurality of individual and arcuately arrayed dispensing portions arranged around a central cross wise extending and rotatable shaft. A driving mechanism is associated with the body for actuating the rotor element to dispense volumes of the held particulate and may include either a hand-operated crank or an electric motor operatively connected to the rotatable shaft and powered by at least one battery contained within the hollow interior of the body and electrically communicable with the motor.

15 Claims, 3 Drawing Sheets

HAND HELD SALT DISPENSING DEVICE

CROSS REFERENCE TO RELATED APPLICATIONS

The present application is a continuation-in-part of U.S. application Ser. No. 09/595,596, filed Jun. 15, 2000, titled Salty Dog Sidewalk Salter, which in turn claims priority from U.S. Provisional Application Serial No. 60/139,716, filed Jun. 18, 1999, titled Salty Dog Sidewalk Salter.

BACKGROUND OF THE INVENTION

1. Field of the Invention

The present invention relates generally to mechanical devices utilized for dispensing salt and like substances, such as onto walkways covered with ice. More particularly, the present invention teaches an improved and portable salt dispensing device, capable of being held in one hand and further easily loaded with a volume of salt for even and measured dispensing.

2. Description of the Prior Art

The prior art is well documented with various types of particulate spreader devices. A first example of this is set forth in U.S. Pat. No. 3,096,984, issued to Garrison, and which teaches a spreader having a tubular, substantially cylindrical housing constructed of a durable plastic. An upper portion of the housing includes a hopper with an open top. A strap is connected to the upper rim of the hopper by fasteners and is adapted to fit over the shoulder of the user to carry the spreader.

The bottom wall of the Garrison device is further sloped and provided with a downwardly convergent portion (funnel). A rectangular shaped discharge port is provided at the bottom of the funnel and a shaft and drive assembly is mounted within the lower confines of the housing for dispensing, via a shaft rotated impeller, a volume of internally held particulate.

U.S. Pat. No. 3,157,402, issued to Love, Jr., teaches a material spreading and broadcasting device which, similar to Garrison, includes a volume holding housing with a downwardly situated impeller discharge. Love, Jr. also teaches a configured grip handle and a downwardly and hingedly closable lid.

U.S. Pat. No. 425,338, issued to Muller, teaches a distributor for flock, sand and tinsel and which includes a uniquely shaped hopper body having a top screw cap. A diaphragm mechanism is situated within the hollow interior of the body and includes a journalled shaft for raising and lowering the diaphragm. An internal hopper feeds particulates to a rotatable brush wheel and which is arranged in communication with a substantially bell-mouthed ejector nozzle. A flexible tube extends from an opposite side of the apparatus and is connected to a suitable blower apparatus for supplying a current of air to the distributor, valve and hopper elements. Upon opening of the diaphragm, the air current is activated to operate the device.

Finally, U.S. Pat. No. 5,123,598, issued to Courtney, teaches a hand held spreading device for broadcast spreading material via a rotating impeller. The device provides an actuating assembly including a dual spring arrangement, hand-crank and impeller/dispenser for feeding particulate from a bottom location of the spreading device.

SUMMARY OF THE INVENTION

The present invention is an improved and portable salt dispensing device, capable of being held in one hand and further easily loaded with a volume of salt for even and measured dispensing. The invention is further an improvement over the prior art in that it provides a simplified and improved device for dispensing volumes of salt and like particulates.

The device has a body, typically constructed of a rigid and durable plastic, and having an elongated and substantially hollowed interior with a forwardly located and open end. A reclosable end cap is engaged with a rearwardly located end for permitting the hollow interior to be filled holding a volume of the particulate material.

A rotor element is mounted in communication with the first open end and includes a plurality of individual and arcuately arrayed dispensing portions arranged around a central cross wise extending and rotatable shaft. A driving mechanism is associated with the body for actuating the rotor element to dispense volumes of the held particulate. In a first variant, a hand-operated crank is provided and is rotated by the user to dispense the salt particulate. In a further variant, an electric motor is operatively connected to the rotatable shaft and powered by at least one battery contained within the hollow interior of the body and electrically communicable with the motor.

An on/off switch or button is located in proximity to a grip portion extending from the body. The grip portion is configured to be gripped by a single hand of a user and, upon positioning the rotor element in a forward and selected angular orientation relative to the ground surface, the switch or button may be depressed to engage the device to apply the particulate material in even and measured fashion upon the ground location.

BRIEF DESCRIPTION OF THE DRAWINGS

Reference will now be made to the attached drawings, when read in combination with the detailed description, wherein like reference numerals refer to like parts throughout the several views, and in which.

DETAILED DESCRIPTION OF THE PREFERRED EMBODIMENTS

Figure 1:
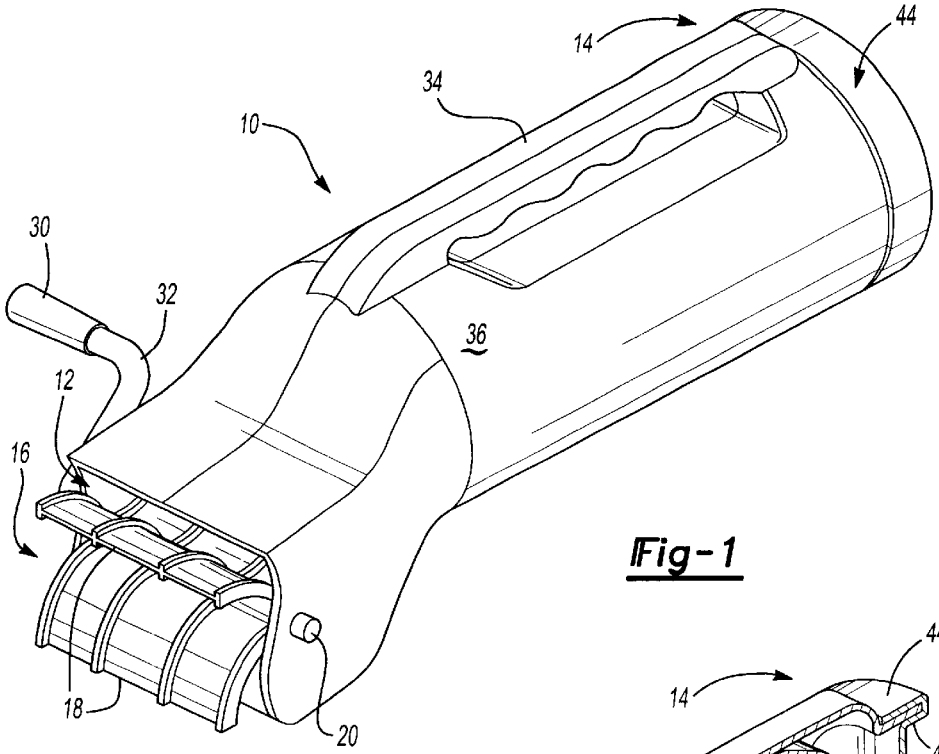
FIG. 1 is a perspective view of the hand held salt dispensing device according to a first preferred embodiment of the present invention.

Referring now to FIG. 1, a perspective view is illustrated at 10 of a hand-held dispensing device for dispensing salt and other types of particulate. As previously described, the present invention teaches an improved and portable salt dispensing device, capable of being held in one hand and further easily loaded with a volume of salt/particulate for even and measured dispensing.

Figure 2:
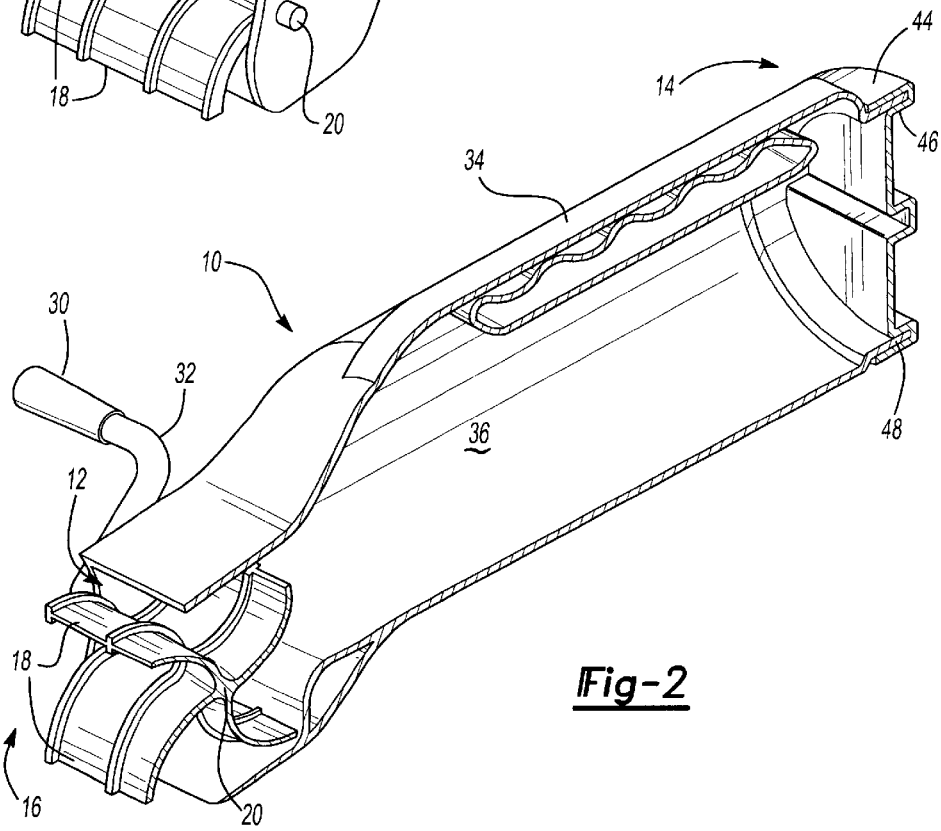
FIG. 2 is a cutaway view in perspective of the dispensing device shown in FIG. 1 and further illustrating the features of the housing, hand grip portion, manual crank and rotor, and engageable end cap according to the present invention.
Figure 3:
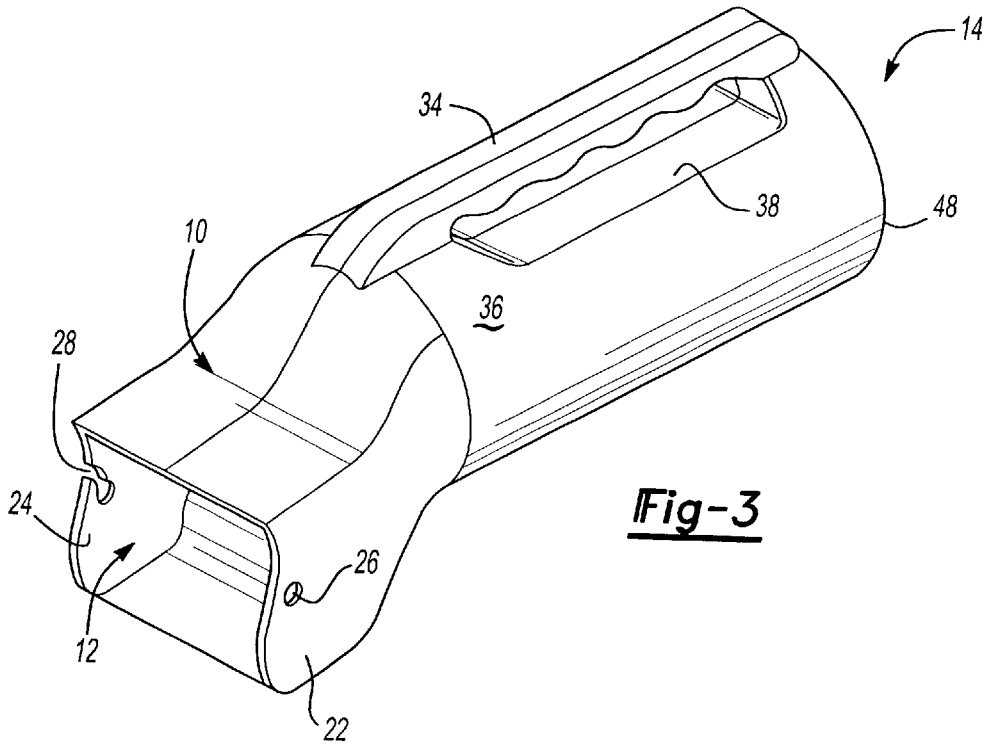
FIG. 3 is a further perspective view in section of the outer housing with integrally formed grip according to the present invention.
Figure 4:
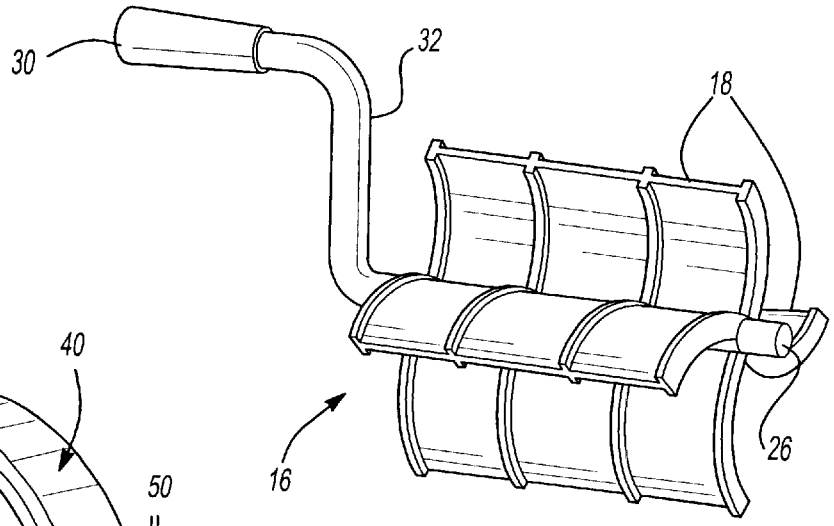
FIG. 4 is a sectional view of the crank handle and rotor according to the present invention.

Referring also to FIGS. 2 and 3, the dispensing device 10 includes a generally elongated, substantially interiorly hollowed, and typically cylindrical shaped body constructed of a durable (typically rigid plastic) material and having a first forwardly located and open end 12 and a second rearwardly located and reclosable end 14. The open forward end 12 is configured for receiving a rotor element 16, the rotor element (see also FIG. 4) including a plurality of individual and arcuately arrayed dispensing portions 18 arranged around a central cross wise extending and rotatable shaft 20. Referring again to FIG. 3, side plates 22 and 24 associated with the front open end 12 of the dispenser body include the provision of a first aperture 26 (side plate 22) and a second channel aperture 28 (side plate 24) for receivably engaging the shaft 20 of the rotor element 16.

A driving mechanism is provided for rotatably engaging the rotor element 16 and, referring again to the drawing illustrations of the first preferred embodiment, includes an arcuately configured and hand operated crank portion with a handle 30 and an angled bracket 32 extending in stepped fashion from the handle 30 and secured, in integral fashion, to the rotatable shaft 20. A grip portion 34 extends, again in typically integral fashion, from an upper surface 36 of the elongated body. The grip portion 34 is typically reinforced (see at 38 in cutaway of FIG. 3) and is configured in such a fashion to permit the user to grasp the device with a single hand.

Figure 5:
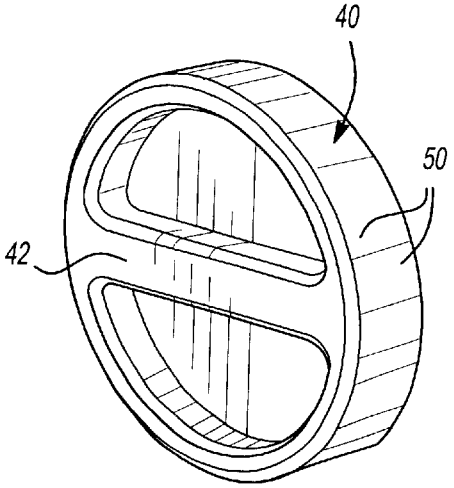
FIG. 5 is a sectional view of the threaded end cap according to the present invention.

The reclosable rear end 14 of the body, in the preferred variant, in a first preferred variant, includes an engageable end cap 40. In one configuration, the end cap 40 includes a graspable portion 42 located on the exterior facing side of the end cap (see FIG. 5), and configured to be engaged by the user. Referring further to the perspective cutaway view of FIG. 2, an opposite and inwardly facing side of the end cap 40 includes a pair of spaced apart and annular extending wall portions 44 and 46. Upon positioning the wall portions 44 and 46, relative to a rear and corresponding annular edge 48 of the body (corresponding with the rear end 48), the end cap 40 is depressed inwardly to resistively engage the annular edge 48 between the opposing, annular and spaced apart wall portions 44 and 46. It is also envisioned that the inner annular surface of the end cap may be configured with interiorly facing threads (see at phantom at 50 in FIG. 5) and which may be rotatably engaged with opposing and exteriorly arranged threads (not shown) located at the rearward end 14 of the body.

Figure 6:
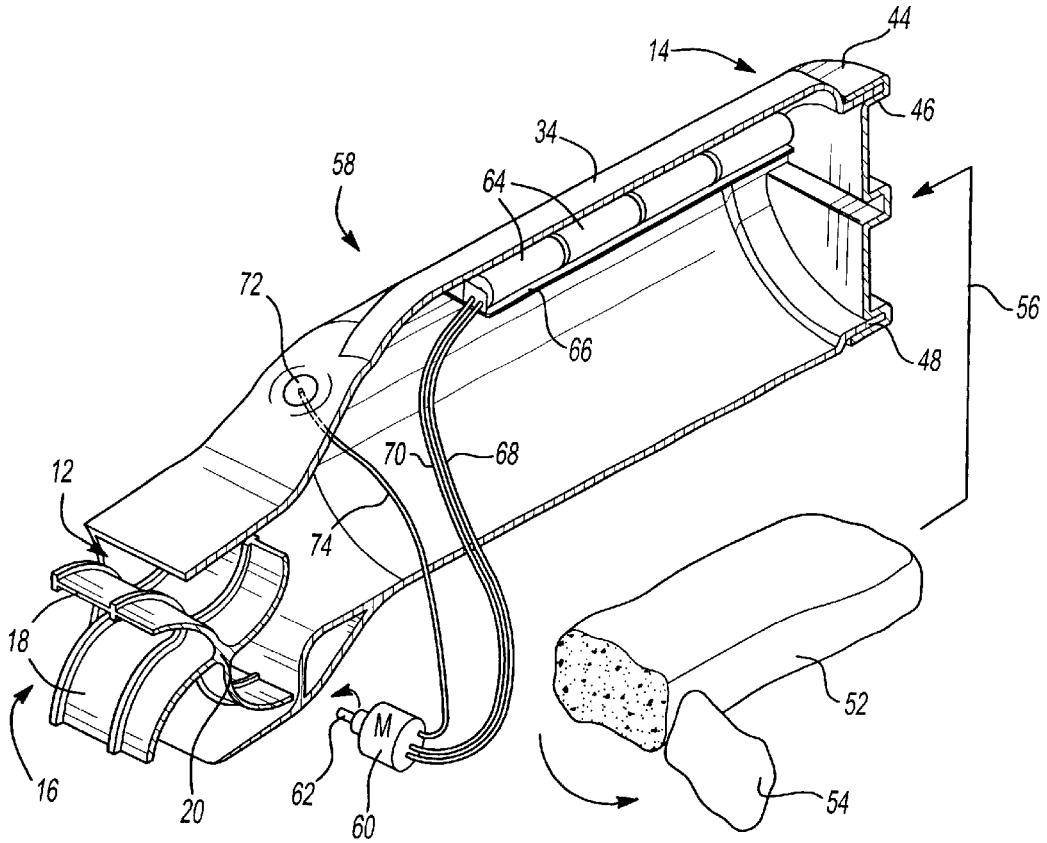
FIG. 6 is a perspective view, in cutaway, of a hand held dispensing device according to a further preferred variant according the present invention and which includes a portable and battery operable motor for driving a modified rotor portion, as well as a prepackaged salt container for inserting in a rearwardly installing direction within the interiorly hollowed body.

In a first variant, the interiorly hollowed body is charged/filled with a volume of the salt particulate (not shown) by removing the end cap and filling the body interior. It is also contemplated that the body may be scooped into a bag or other container (also not shown) holding salt particulates, following which the end cap 40 is resistively re-engaged to the body. Referring also to FIG. 6, the quantities of salt particulate may also be incorporated into a prepackaged container, such as bag 52, and which may also include a tear away top 54. Upon opening the bag 52, by tearing away the top 54, the bag is loaded into the body through the reclosable rear end 14 (see directional arrow 56).

In use, the grip portion 34 is grasped by a single hand of the user and such that the forward end of the body is arranged in a selected angular (typically downward) orientation relative to the ground surface. The hand crank 30 is then rotated to likewise rotate and activate the rotor element and to proceed to dispense, in measured fashion, the interiorly held salt particulates upon the ground surface, such typically being covered ice.

Referring again to FIG. 6, a further variant 58 is illustrated of the portable device according to the present invention and which discloses a motorized variant for activating the dispensing rotor element. Specifically, the portable device 58 includes the provision of an electric motor 60 operatively connected to a slightly modified rotor element 16' and having a rotatable output shaft 62 rotatably engageable with the central rotating shaft 20' associated with the rotor element 16'. Although illustrated in exploded fashion in FIG. 6, it is understood that the electric motor 60 is configured and positioned within the interior of the dispensing body in such a fashion as to maintain the overall ergonomic configuration of the device, while at the same time effectively engaging the rotor element. It is further contemplated that additional components, such as bevel gears or like mechanical motion converting components, can be incorporated into the design of the dispensing device and in order to operatively engage the electric motor 60 with the rotor element.

A power supply is associated with the body for operating the electric motor and rotor element and, in one preferred variant, includes batteries 64 contained within the hollow interior, such as loaded into a suitable axially extending compartment 66 and electrically communicable with the motor 60 through input and output wires 68 and 70 extending therebetween.

Figure 7:
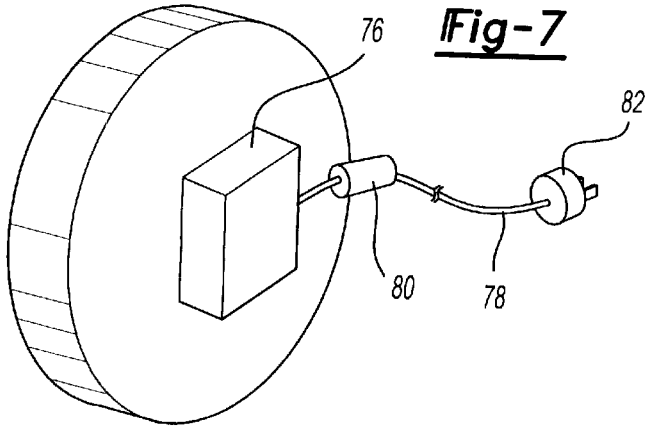
FIG. 7 is a sectional view of the threaded end cap, illustrated in substantially rotated fashion, and showing a rechargeable option for operating the portable motor.

An on/off button 72 is positioned proximate a forward end of the grip portion 34 and is capable of being activated, such as by the thumb of the user's hand gripping the device, for selectively activating and deactivating the motor and the rotor element and via a further wire 74. Referring also to FIG. 7, the battery may further be provided as one or more rechargeable batteries, such as which may be mounted at a location similar to that show by the batteries 64 in FIG. 6.

Alternatively, a single rechargeable unit ma be positioned to another location within the body, such as upon the inner face of the reclosable end cap, see at 76 in FIG. 7. An AC/DC adapter, illustrate generally at 78, may be communicated with the rechargeable battery 76, via a first input end 80, and includes a second end 82 communicable with a conventional outlet wall plug (not shown).

It is evident therefore that the present invention discloses an inexpensive, safe and easily operated dispensing device which is an improvement over prior art devices. The present device further requires no tools or assembly, is durable in use, and ergonomically configured to provide a maximum degree of comfort and ease of operation.

Having described my invention, additional preferred embodiments will become apparent to those skilled in the art to which t pertains, and without deviating from the scope of the appended claims.

I claim:

1. A portable device for dispensing a particulate material upon a ground surface, comprising:

a body having a substantially hollow interior with a forwardly located and open end, said body further including an end cap engaged with a rearwardly located end of said body for permitting said hollow interior of said body to hold a volume of the particulate material;

a rotor element mounted in communication with said forwardly located and open end, said rotor element further comprising a plurality of individual and arcuately arrayed dispensing portions arranged around a central cross wise extending and rotatable shaft and so that selected dispensing portions project beyond said forwardly located open end;

driving means associated with said body for actuating said rotor element to dispense volumes of the held particulate; and a grip portion extending from said body and configured to be gripped by a single hand of a user to position said rotor element in a forward and selected angular orientation relative to the ground surface.

2. The portable device as described in claim 1, said end cap further comprising a friction fitting and annular shaped portion.

3. The portable device as described in claim 1, said end cap further comprising interiorly facing and annular extending threads rotatably engageable with exteriorly facing threads arranged in annular extending fashion about said rearward end of said body.

4. The portable device as described in claim 1, said driving means further comprising a hand-operated crank operatively connected to said rotor element.

5. The portable device as described in claim 1, said driving means further comprising an electric motor operatively connected to said rotor element.

6. The portable device as described in claim 5, said driving means further comprising a power supply associated with said body for operating said electric motor and rotor element.

7. The portable device as described in claim 6, said power supply further comprising at least one battery contained within said hollow interior and electrically communicable with said motor.

8. The portable device as described in claim 7, further comprising an on/off button for selectively activating and deactivating said motor and said rotor element.

9. The portable device as described in claim 7, said battery further comprising a rechargeable battery, an AC/DC adapter having a first end communicable with said rechargeable battery and a second end communicable with a conventional outlet wall plug.

10. The portable device as described in claim 1, further comprising a prepackaged container of particulate capable of being loaded into said body hollow interior prior to dispensing.

11. The portable device as described in claim 10, said prepackaged container further comprising a tear-away top.

12. The portable device as described in claim 1, said body having a specified elongated and substantially cylindrical shape and being constructed of a rigid and durable plastic material.

13. A portable device for dispensing a particulate salt material upon a ground surface, comprising:

a body having a substantially hollow interior with a forwardly located and open end, said body further including a reclosable end cap engaged with a rearwardly located end of said body and for permitting said hollow interior of said body to hold a volume of the particulate material;

a rotor element mounted in communication with said forwardly located and open end, said rotor element further comprising a plurality of individual and arcuately arrayed dispensing portions arranged around a central cross wise extending and rotatable shaft;

driving means associated with said body for actuating said rotor element to dispense volumes of the held particulate, said driving means including a hand-operated crank connected to said cross wise extending and rotatable shaft; and a grip portion extending from said body and configured to be gripped by a single hand of a user to position said rotor element in a forward and selected angular orientation relative to the ground surface.

14. A portable device for dispensing a particulate salt material upon a ground surface, comprising:

a body having a substantially hollow interior with a forwardly located and open end, said body further including a reclosable end cap engaged with a rearwardly located end of said body and for permitting said hollow interior of said body to hold a volume of said particulate material;

a rotor element mounted in communication with said forwardly located and open end, said rotor element further comprising a plurality of individual and arcuately arrayed dispensing portions arranged around a central cross wise extending and rotatable shaft;

driving means associated with said body for actuating said rotor element to dispense volumes of said held particulate, said driving means including an electric motor operatively connected to said rotatable shaft of said rotor element and powered by at least one battery contained within said hollow interior of said body and electrically communicable with said motor, an on/off button selectively activating and deactivating said motor and said rotor element; and a grip portion extending from said body and configured to be gripped by a single hand of a user to position said rotor element in a forward and selected angular orientation relative to the ground surface.

15. A portable device for dispensing a particulate material upon a ground surface, comprising:

an elongated body having a substantially hollow interior with a forwardly located and open end, said body further including an end cap being reclosably engaged with a rearwardly located end of said body and for permitting a prepackaged container of the particulate material to be opened and inserted within said hollow interior of said body;

a rotor element mounted in communication with said forwardly located and open end and comprising a plurality of individual and arcuately arrayed dispensing portions arranged around a central cross wise extending and rotatable shaft;

driving means associated with said body for actuating said rotor element to dispense volumes of the held particulate; and a grip portion extending from said body and configured to be gripped by a single hand of a user to position said rotor element in a forward and selected angular orientation relative to the ground surface.

* * * * *